US006573665B2

(12) United States Patent
Cooper et al.

(10) Patent No.: US 6,573,665 B2
(45) Date of Patent: Jun. 3, 2003

(54) INSPECTION LAMP WITH INTERCHANGEABLE AC OR DC POWER CORDS

(75) Inventors: B. William Cooper, Lloyd Harbor, NY (US); Richard Regan, Short Hills, NJ (US); Gustavo Garcia, Lake Grove, NY (US)

(73) Assignee: Spectronics Corporation, Westbury, NY (US)

( * ) Notice: Subject to any disclaimer, the term of this patent is extended or adjusted under 35 U.S.C. 154(b) by 0 days.

(21) Appl. No.: 09/912,698

(22) Filed: Jul. 25, 2001

(65) Prior Publication Data

US 2002/0014866 A1 Feb. 7, 2002

Related U.S. Application Data

(60) Provisional application No. 60/222,335, filed on Aug. 1, 2000.

(51) Int. Cl.[7] ..... G05F 1/00; H01K 7/00

(52) U.S. Cl. ..... 315/291; 315/76; 315/363

(58) Field of Search ..... 315/291, 56, 76, 315/363; 362/190, 197, 198, 396

(56) References Cited

U.S. PATENT DOCUMENTS 5,907,197 A * 5/1999 Faulk ..... 307/119
6,160,728 A * 12/2000 Peterson et al. ..... 363/146
6,265,828 B1 * 7/2001 Jannson ..... 315/76

* cited by examiner

*Primary Examiner*—Hoang Nguyen
(74) *Attorney, Agent, or Firm*—Drinker Biddle & Reath LLP

(57) ABSTRACT

A hand-held inspection lamp is described. The lamp includes a multi-pin receptacle capable of connecting to a cord carrying alternating current and, alternatively, a cord capable of carrying direct current. The pins of the receptacle are wired to appropriate hardware within the lamp such that the proper type of current is supplied to a bulb housed therein. Thus, if the lamp is configured for a bulb that utilizes AC current, the pin configuration of the receptacle and an AC power cord supply AC current directly to the bulb or a ballast. The DC power cord has pins configured to supply current to an inverter connected to the bulb or ballast through the receptacle. A similar, but converse, arrangement is provided for the lamp when designed to house a bulb that utilizes DC current.

50 Claims, 6 Drawing Sheets

FIG.5A
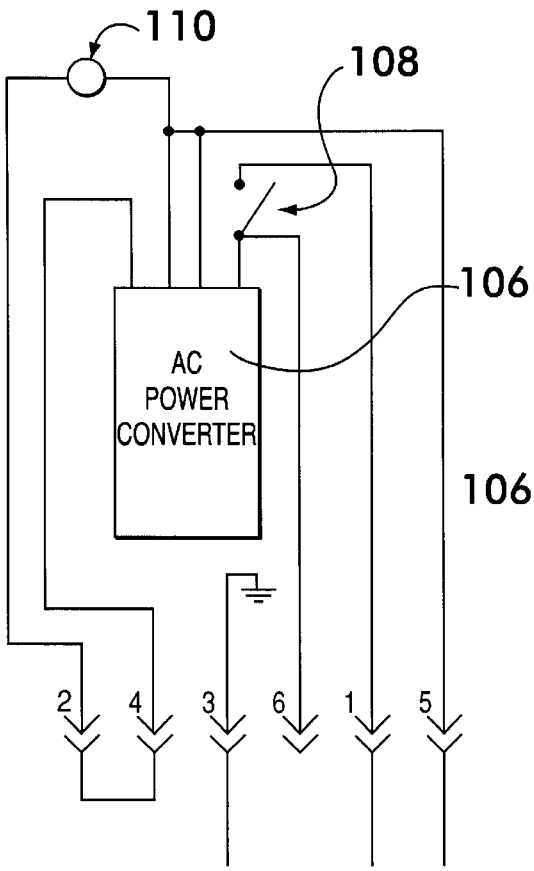
AC
FIG.5C
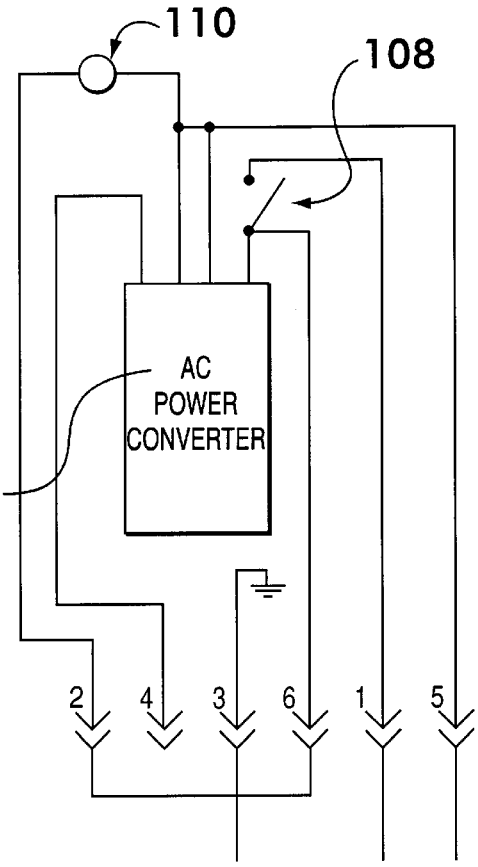
DC
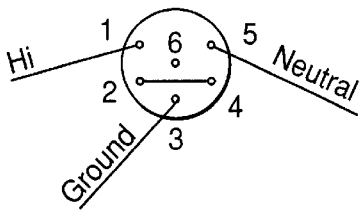
FIG.5B
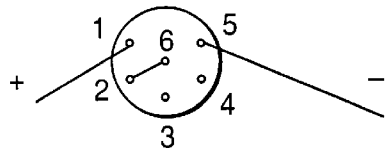
FIG.5D

INSPECTION LAMP WITH INTERCHANGEABLE AC OR DC POWER CORDS

This application claims benefit of Ser. No. 60/222,335 filed Aug. 1, 2000.

FIELD OF THE INVENTION

This invention relates to hand-held electric lamps, and in particular to hand-held inspection lamps with external electrical power supply.

As used herein, the term inspection lamp encompasses general illumination lamps and lamps with various color filters to emit light in selected ranges of wavelength, including infrared, visible and ultraviolet. The particular lamps described in this specification are filtered to emit in the ultraviolet and/or blue ranges to cause a flourescent response from flourescent tracer dyes for leak detection, coating and surface flaw inspection, and UV curing.

BACKGROUND OF THE INVENTION

Inspection lamps requiring external electrical power supply are usually designed to connect exclusively to an alternating current (AC) or to a direct current (DC) power source, but not interchangeably to either AC or DC. Inspection lamps designed to connect to a DC source are typically smaller light-weight portable with a power cord having alligator clips for connecting to battery terminal posts or a plug for an automobile lighter socket. The AC lamps are typically larger and heavier, and have a power cord terminating in a three-prong grounded plug for use with an AC line voltage outlet.

SUMMARY OF THE INVENTION

The invention is directed to inspection or curing lamps which can be quickly configured to connect to either an AC outlet or a DC power source merely by changing to the appropriate power cord. The pin connections between the cords and lamp are adapted to connect or to by-pass certain internal circuitry within the lamp.

One type of lamp, for example, may have an internal AC to DC power converter enabling it to supply direct current to the bulb, regardless of the source. Another type of lamp may have an internal DC to AC converter to supply line voltage AC to the lamp, or to a transformer or impedance ballast to produce a particular voltage, frequency or waveform for lamp operation. Either type of lamp, in accordance with this invention, will have at least two detachable power cords with a multi-pin connection to the lamp. The pin connector circuitry in the lamp will remain unchanged by the power cord selection, but the pin connector circuitry in the power cords vary in how they connect certain pin sockets to the power source.

Typically, a power cord for AC line voltage has a three-prong grounded outlet plug. A power cord for DC typically has battery clips or a cigarette lighter plug. In this invention, a multi-pin plug at the opposite end of the power cord has the same number and configuration of pins in both the AC and DC cords, but the pin connections in the cord differs between the AC cord and the DC cords.

Using this invention in a lamp where a tungsten-halogen incandescent bulb is intended to be powered by 12-volt direct current, for example, the pin connections in the AC power cord automatically route the AC line current to an AC to DC power converter within the lamp, while the pin connections in the DC cords automatically by-pass the converter. Conversely, using the invention in a lamp where a high intensity discharge (HID) bulb is intended to be powered by high-voltage high-frequency alternating current, the pin connections in the DC power cords automatically route the DC current to a DC to AC power converter within the lamp, while the pin connections in the AC cords would automatically by-pass the converter and route the AC line current directly to a transformer/ballast device.

Various internal circuitry and pin configurations can be used, depending in part upon whether a particular polarity is required. Several alternative configurations are described herein.

In addition, there may be other novel features of the particular lamps described. The lamp with an AC-powered MDL light source has several safety features in its configuration.

BRIEF DESCRIPTION OF THE FIGURES

FIG. 5A is an electrical schematic depiction of the lamp and AC power cord of FIG. 4C.

FIG. 5B is a depiction of the pin socket connections on the power cord of FIG. 4C.

FIG. 5C is an electrical schematic depiction of the lamp and DC power cord of FIG. 4A.

FIG. 5D is a depiction of the pin socket connections on the power cord of FIG. 4A.

DETAILED DESCRIPTION OF THE INVENTION

The invention is described herein as embodied in several lamps and cord configurations which allow the lamp to be powered by either AC or DC power sources. The most common power sources are 100V/60 Hz AC power and 12V DC power. 110V/60 Hz is the prevalent outlet power in the United States, and 12V DC is prevalent in automobiles and automobile batteries. The two lamp examples which follow are a lamp using an AC-powered HID bulb, and a lamp with a DC-powered tungsten-halogen bulb. While some alternatives are suggested in the following text, neither the specific examples or the suggested alternatives are intended to exhaustively describe all of the forms in which the invention can be embodied.

EXAMPLE OF LAMP WITH AC-POWERED KID BULB

Figure 1:
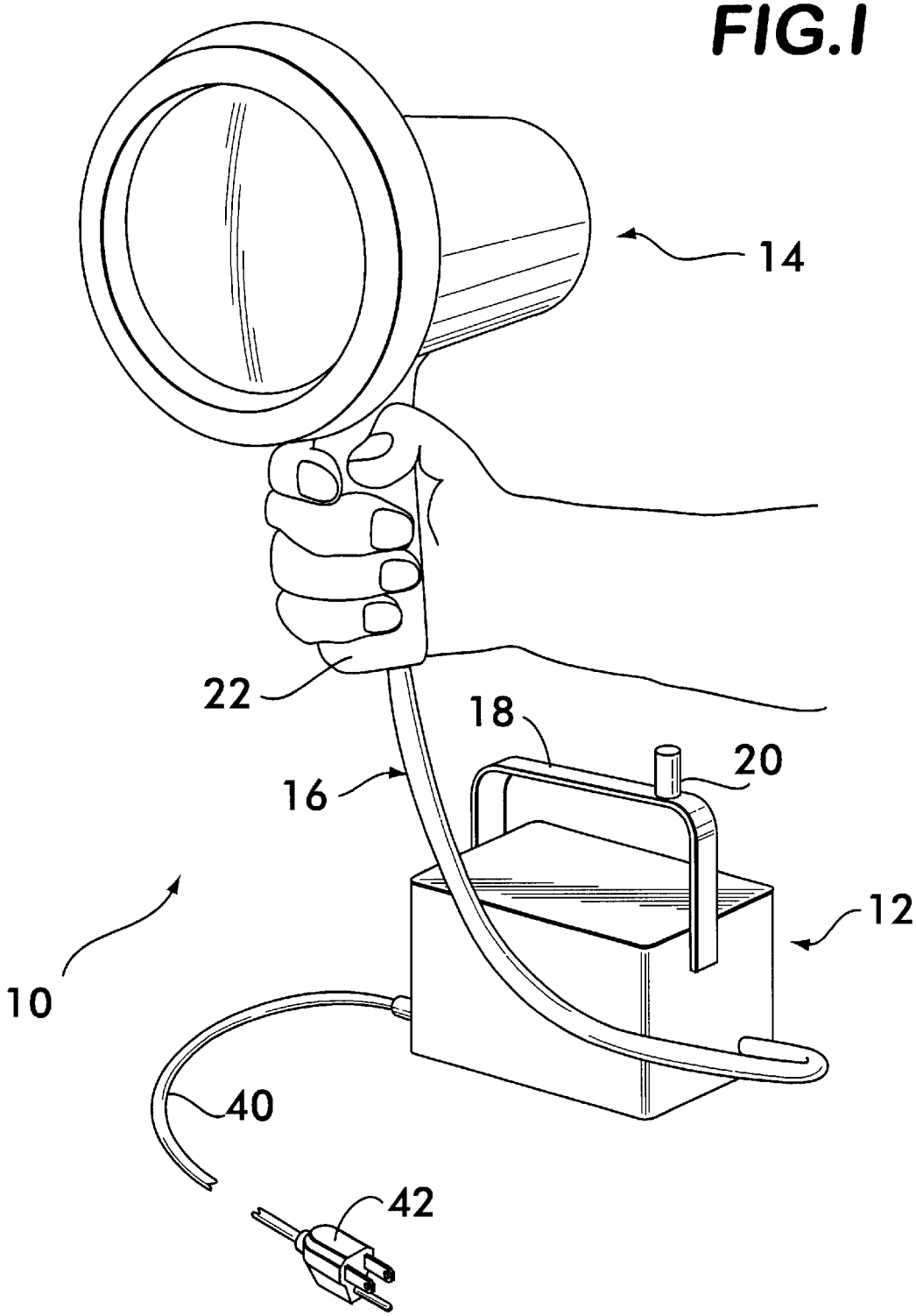
FIG. 1 is a view of an inspection lamp according to the invention with an ac power cord.
Figure 2:
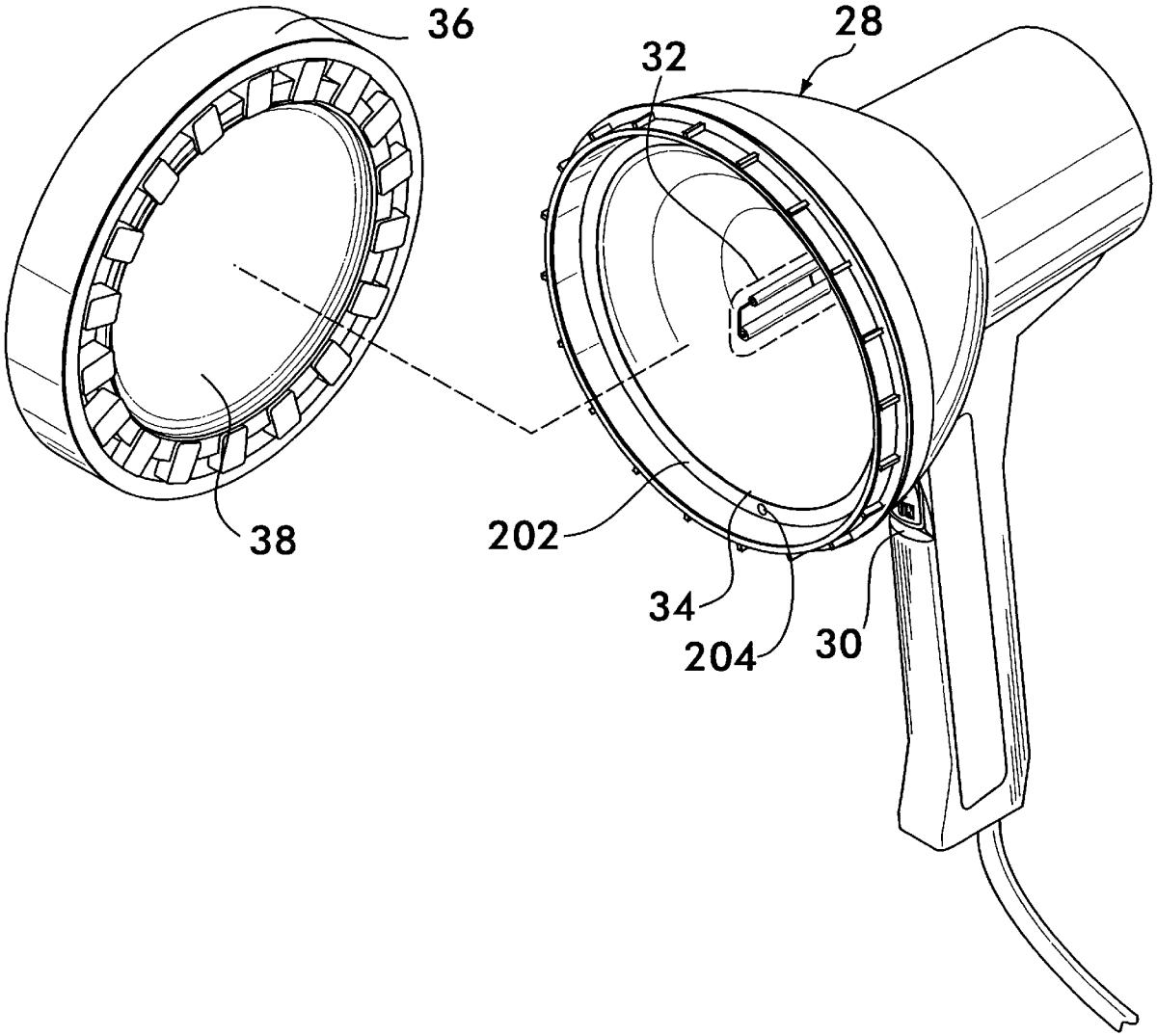
FIG. 2 is a view of the lamp of FIG. 1 with the filter holder removed.

FIGS. 1 and 2 depict an inspection lamp 10 for producing a fluorescent response from dye additives for detecting fluid leaks in large closed containers or circulating systems, or producing a fluorescent response from penetrating dyes in NDT inspection for surface flaws, or detecting voids or dis-uniformity in coatings. A lamp of this type may be used to scan relatively large surfaces at relatively long distances to produce a fluorescent response. To excite a small accumulation of fluorescent dye sufficiently to cause a fluorescent response under these conditions, the lamp must emit high radiant power in the dye's excitation band. For example, a lamp of this type used to detect the presence of a fluorescent material using a perylene fluorescent dye should emit high radiant power in the UV-A range between 340 and 380 nm to take advantage of the perylene response peak in that range. To create this high emittance, the inspection lamp 10 uses a micro-discharge halide light source (MDL) similar to that used in some automobile headlights, which provides a high level UV-A energy and has nearly instant start and restart capabilities. MDL sources of this type are available in commercially produced bulbs, such as a Phillips DUV -35W.

These MDL bulbs require special transformer/ballasting equipment to provide a voltage and frequency higher than normal 100V/60 Hz for continuous operation, and extremely high open-circuit voltage for instant restart when hot. In particular, this lamp 10 uses an electronic transformer/ballast device to convert line power to approximately 390V, 400 Hz open circuit (ballasted to maintain 50–150 V during operation). Then to achieve hot restart, it uses an ignition booster to create an open circuit voltage of 24,000V maintained for approximately a 1.2 second pulse until the discharge arc is established. These electronic devices are housed within the lamp 10 as described hereafter.

Referring now to FIG. 1, the lamp 10 comprises an electronics housing 12 and a hand-held illumination unit 14, connected by an electrical conduit 16. The electronics housing has a carry handle 18, with a post 20 that acts as a stand for the hand held unit when not in use. The pistol grip handle 22 of the hand-held unit has an aperture (not visible in the drawings) to fit over the post 20. This post/stand arrangement is not new, and has been used by the applicants' assignee for several years.

Because of the high voltage of this ignition device (referring now to FIG. 3A), the ballast device 24 is kept in the electronics housing and the ignition device 26 is moved into the hand-held unit 14. This eliminates the potential hazard of having 24,000V across a conduit 16 that could have its shielding insulation compromised through wear.

Referring now to FIG. 2, the hand-held unit has a pistol grip handle 22 attached to a bulb/reflector housing 28. The pistol grip handle has an ON/OFF switch 30 that must be held in the ON position to supply power to the MDL bulb 32. Inside the bulb/reflector housing 28 is a smooth surfaced aluminized reflector 34 contoured to produce a long focal length. Attached to the end of the bulb/reflector housing is a removable silicon rubber filter holder 36, into which is inserted an appropriate light filter 38.

A bulb/reflector assembly may be provided as a single unit. Thus, the assembly may be installed and removed from the bulb/reflector housing as described below. The reflector is secured around the base of the bulb, the electrical contacts of the bulb extending through the reflector. The base of the bulb includes bayonet pins extending transversely from the long axis of the bulb, such that the bulb/reflector assembly may be pushed downwardly into a socket and rotated slightly to lock each bayonet pin into the closed side of a J-shaped channel provided in the socket.

Figure 6:
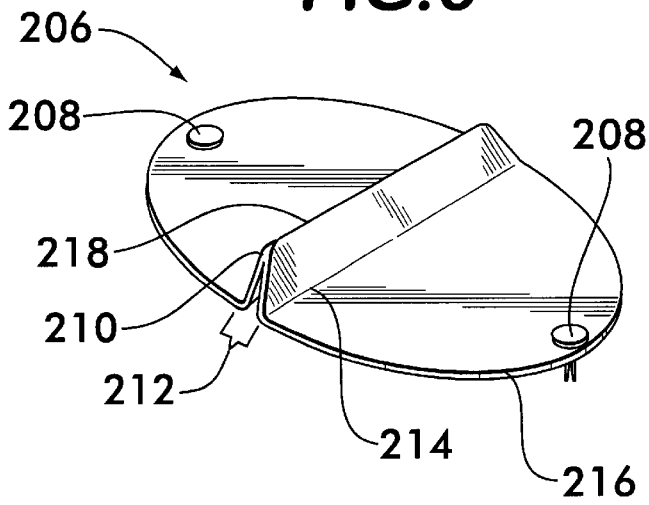
FIG. 6 is a perspective view of a novel protective cover for a bulb and reflector assembly.
Figure 7:
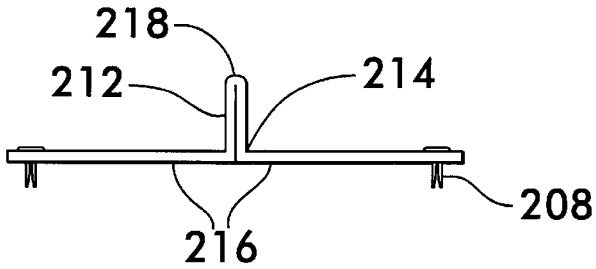
FIG. 7 is a side view of the protective cover shown in FIG. 6.

The reflector 34 is provided with an external collar 202, through which a pair of apertures 204 are furnished, one of the apertures 204 being hidden in FIG. 2. A protective cover 206 is shown in FIGS. 6 and 7. The cover 206 is generally round, shaped to correspond with the opening of the reflector 34 and to cover the external collar 202. Two tabs 208 protrude through the cover 206, positioned to correspond with the apertures 204. When a user opens the packaging of the reflector/bulb assembly, the cover is in place with tabs 208 engaging apertures 204, thereby protecting the aluminized surface of the reflector 34. The user may grasp a handle 210, which is conveniently provided on the cover 206. The bulb and reflector may then be inserted into the housing and secured into place via a twisting motion, without ever being touched by the user. Once the reflector is secured, a withdrawing motion forces the tabs 208 to disengage apertures 204, allowing removal of the cover 206 from the reflector 34.

The protective cover may be formed from any material having suitable rigidity to support the necessary handling, inserting, and rotating actions described above. One acceptable material is rigid cardboard. A single piece of cardboard may be cut in a shape comprised of a rectangular center section 212 separated by fold lines 214 from semicircular ends 216. A central fold line 218 is parallel with fold lines 214 and bisects the central portion 212. Folding the single piece of cardboard along the three fold lines provides a round base, which has a circumference corresponding with the shape and size of the reflector collar 202, and a handle 210 perpendicular thereto. Various designs of holes (not shown) may be provided in the handle 210 to facilitate grasping. Further, a fastener (not shown) may be provided to secure the two halves of the handle to one another and prevent unfolding of the cover.

Figure 8:
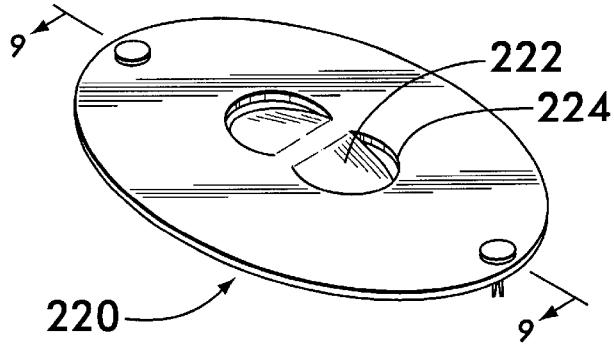
FIG. 8 is a perspective view of a second embodiment of the protective cover for a bulb and reflector assembly.
Figure 9:
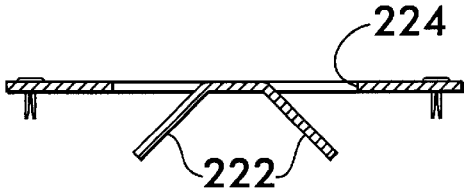
FIG. 9 is a cross-sectional view of the embodiment shown in FIG. 8 taken along line 9—9.

Another embodiment of the cover 220 is shown in FIGS. 8 and 9. This cover 220 may be formed from a single circular piece of rigid material, preferably cardboard. Two or more punch out tabs 222 are defined by lines of weakness 224 on three sides. The lines of weakness may be scored or die cut into the cover using any of the techniques well known to those skilled in the art. The fourth side of each punch out tab is left unscored such that the tabs do not become unattached when knocked out, thereby preventing them from falling into the reflector. The tabs are positioned such that an average user can insert fingers therethrough to grasp the cover. Caution must be used, however, in not putting fingers through so far as to contact the reflector or the bulb.

The lamp 10 is supplied with at least two power cords. The power cord 40 in FIG. 1 has a three pronged grounded plug 42 on one end for connecting to an AC outlet. This type of plug is also shown schematically in FIG. 3C. The lamp is also supplied with at least one alternative power cord 50, having a device for connection to a DC source, such as the battery terminal clips 52 of FIG. 3B or the lighter plug 54 of FIG. 3A. Regardless of the type of connection device on the end of the cord distal to the lamp, the proximal end of the cord has a multi-pin connector, herein a six-pin plug 44A, 44B. The electronics housing 12 has a corresponding receptacle 48 with six pins. Inside the plug, the pin sockets are wired to the power cord according to the type of power supply to be used.

Figure 3C:
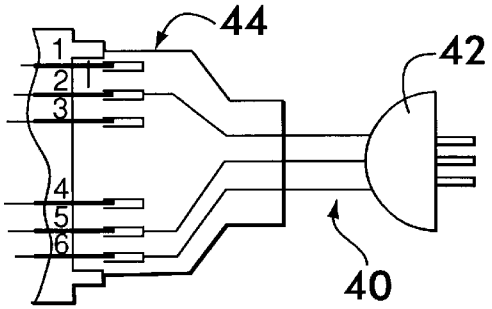
FIG. 3C is a schematic representation of an AC power cord.
Figure 3B:
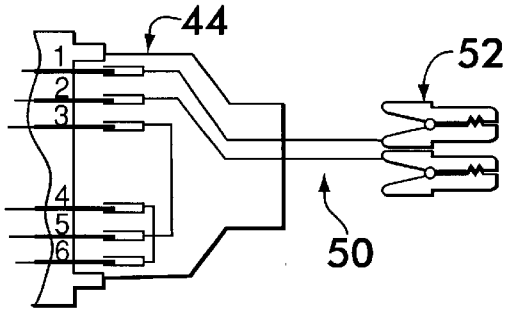
FIG. 3B is a schematic representation of an alternative form of DC power cord.
Figure 3A:
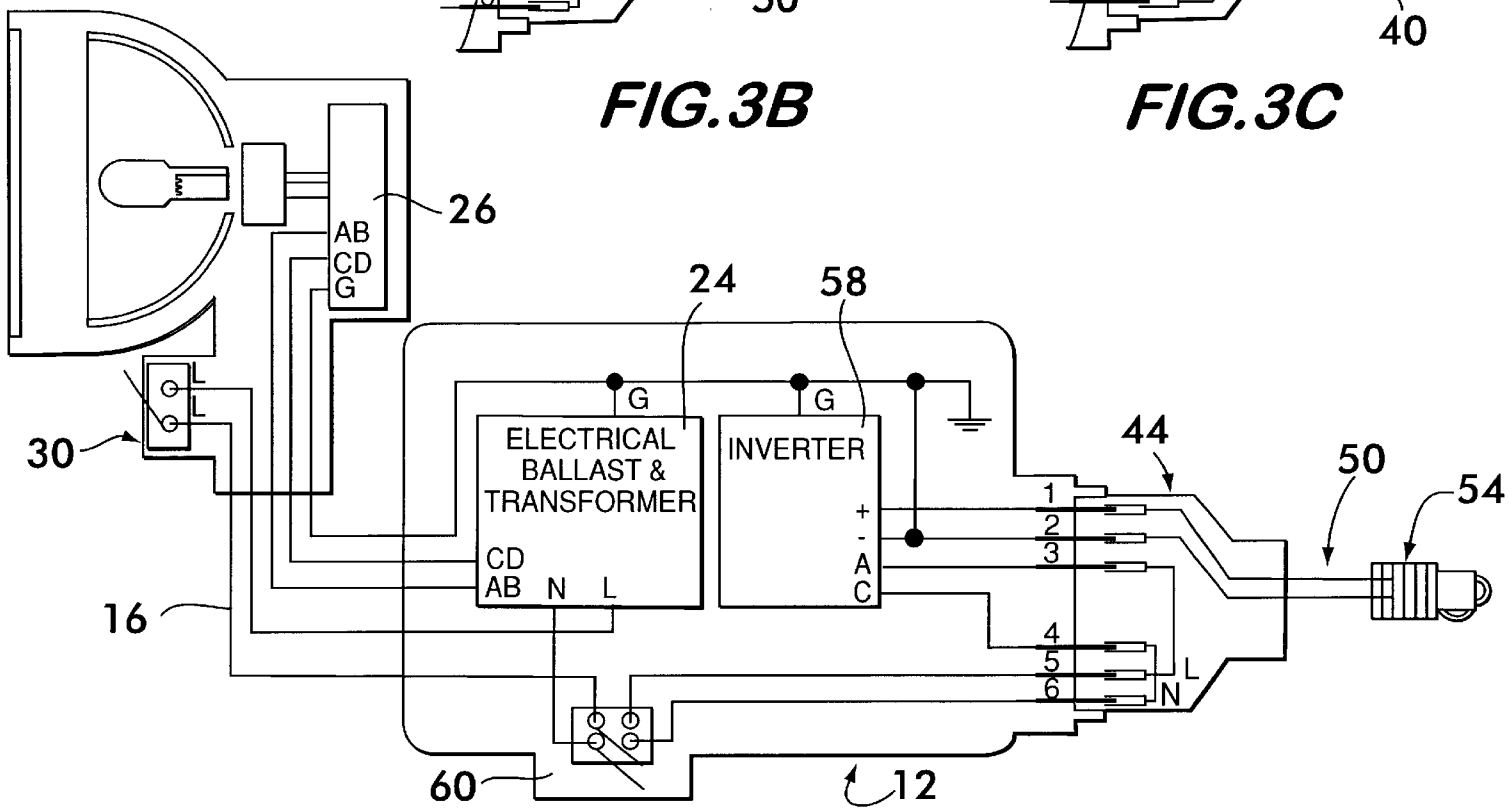
FIG. 3A is a schematic representation of an inspection lamp similar to the lamp of FIG. 1 except with a DC power cord.

For instance, in the schematic of FIG. 3A, the power cord 50 is for a DC power supply from an automobile lighter. The plug 44A is wired so that the positive DC contact will be connected to pin socket 1. The negative contact is wired to pin socket 2. Pin socket 3 is wired to pin socket 5, and pin socket 4 is wired to pin socket 6. The cord 50 shown in FIG. 3*b* is essentially the same as the cord in FIG. 3A, except that it has battery terminal clips 52 instead of the lighter plug 54.

Inside the electronics housing 12, the receptacle pins corresponding to plug sockets 1 and 2 are wired to the input terminals of an inverter 58, which takes in the 12V DC and outputs 100V, 60 Hz AC power. The output from the inverter 58 is routed through pins 3 and 4, which are in turn connected back into the housing by pins 5 and 6. Pins 5 and 6 are connected to an ON/OFF switch 60 on the electronics housing.

Placing the manual switch 60 "ON" supplies 100V, 60 Hz power to the electronic ballast and transformer device 24 described above to deliver 400 Hz AC at approximately 390V open circuit (ballasted to maintain 50–150 V during operation) through conduit 16. When the ON/OFF 30 switch is depressed, the ignition device 26 starts the MBL bulb's discharge arc and the lamp illuminates.

The plug 44B shown in FIG. 3C is for connecting the lamp to a 110V AC outlet. In this plug, the ground terminal is wired to pin socket 2. The AC power lines are wired to pin sockets 5 and 6. Pins 5 and 6 then bypass the inverter and deliver 110V, 60 Hz AC power directly to the transformer. Thereafter operation is as described above.

EXAMPLE OF LAMP WITH A DC-POWERED TUNGSTEN-HALOGEN BULB

Figure 4A:
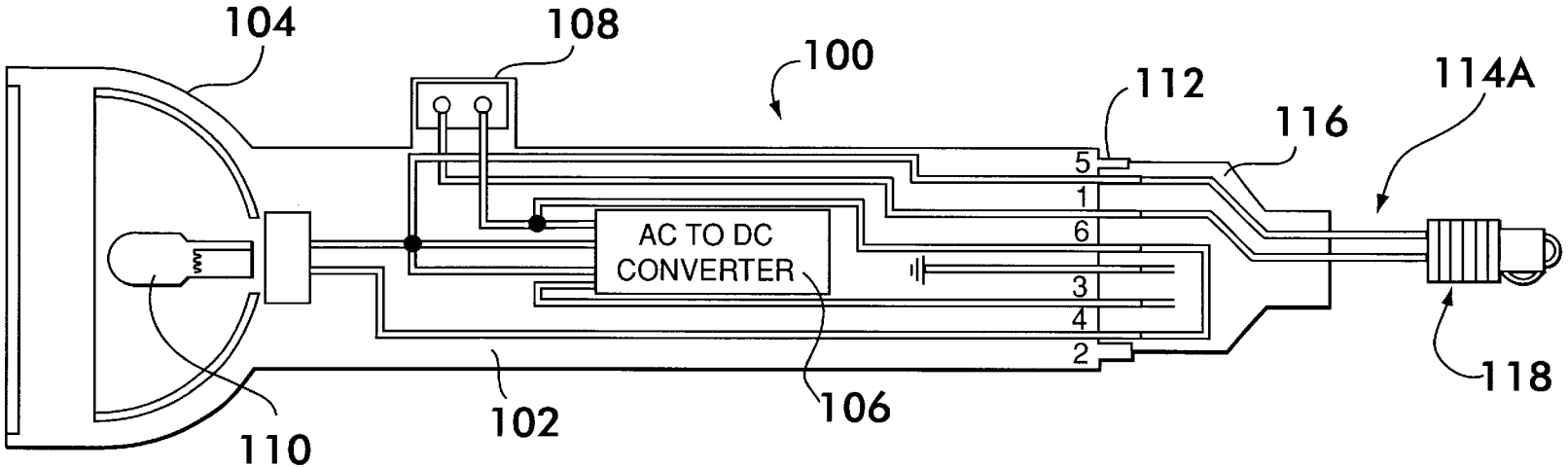
FIG. 4A is a schematic representation of an alternative form of inspection lamp with a DC power cord.

FIG. 4A is an example of a smaller hand-help inspection lamp 100 that is intended for use at closer range and in more restricted space than the larger lamp described above. This type of lamp, for example, may be used to inspect for leaks in an automotive air conditioning system. Since the range is less, the lamp can produce a fluorescent response without needing as high intensity radiance from the light source. For increased maneuverability in tight compartments, the lamp is constructed in a compact style having a handle 102 in line with the bulb/reflector housing 104. The handle encloses an AC to DC converter 106 and has a momentary ON/OFF switch 108. This lamp uses a tungsten halogen bulb 110 that is designed for use with 12 V DC.

At the end of the handle away from the bulb/reflector housing is a multi-pin receptacle, herein a six-pin receptacle 112. The lamp of FIG. 4*a* has a power cord 114A connected to the receptacle that has a plug 116 with six pin sockets at one end and a lighter plug 118 at the other end.

Figure 4B:
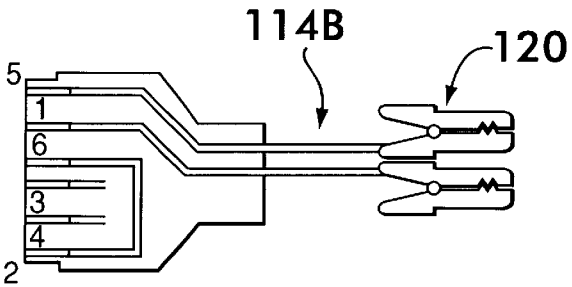
FIG. 4B is a schematic representation of an alternative form of DC power cord.

As shown in FIGS. 5C and 5D, the plug 116 is wired so that the positive DC contact will be connected to pin socket 1. The negative DC contact is wired to pin socket 5. Pin socket 2 is wired to pin socket 6. Pin sockets 3 and 4 are not connected. The cord 114B shown in FIG. 4B is essentially the same as the cord 114A in FIG. 4A, except that it has battery terminal clips 120 instead of the lighter plug 118.

Inside the lamp, as shown also in FIG. 5C, pin 1 is connected to one side of the momentary ON/OFF switch 108. The other side of switch 108 brings DC voltage to the input of an AC to DC converter 106, but bypasses the converter through pin 6 to pin 2, and then to one terminal connection of the bulb. The other bulb terminal is connected to pin S, completing a DC circuit through bulb 110 when the switch is moved to the "ON" position. Pin 3 is connected to ground and pin 4 to the output of the AC/DC converter, but the respective sockets 3 and 4 are not connected in the DC cords.

Figure 4C:
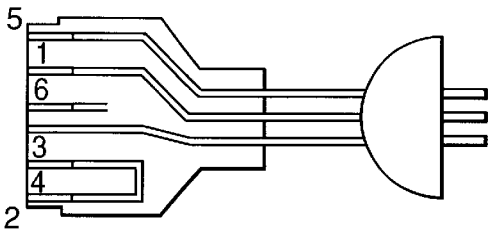
FIG. 4C is a schematic representation of an AC power cord.

In the AC power cord of FIGS. 4C, SA and 5B, pin socket 1 is connected to the hi-side prong of the three-prong AC plug, pin socket 5 to the neutral prong, and pin socket 3 to the ground prong. Pin sockets 2 and 4 are connected together, and socket 6 is not connected. Inside the lamp the pin wiring remains unchanged. Pin 1 is wired to the ON/OFF switch 108. When the switch is moved to ON, AC power is connected to the input side of the AC to DC converter 106. 12V DC power is then output from the converter through pin 4 out through the plug to pin 2 to a terminal connector of the bulb. The other bulb terminal is connected to the neutral pin 5. Pin 3 connects the supply ground to the lamp ground.

Other internal lamp configuration, with corresponding AC and DC power cords, can be used to accomplish the same result. Thus, the present invention may be embodied in other specific forms without departing from the spirit or essential attributes thereof and, accordingly, reference should be made to the appended claims, rather than to the foregoing specification, as indicating the scope of the invention.

What is claimed is:

1. A hand-held lamp comprising:

an electronics housing including a carry handle;

an illumination unit adapted to house a bulb that utilizes a first type of electrical current, the illumination unit being in electrical communication with the electronics housing;

a power converter housed within the electronics housing in electrical communication with the illumination unit;

a receptacle on the electronics housing including, two or more connections in electrical communication with the illumination unit independent of the power converter, and two or more connections in electrical communication with the illumination unit via the power converter;

a first power cord having a first termination with connections corresponding with the two or more connections in electrical communication with the illumination unit independent of the power converter and a second termination adapted to connect to a power supply of the first type of electrical current; and a second power cord having a first termination with connections corresponding with the two or more connections in electrical communication with the illumination unit via the power converter and a second termination adapted to connect to a power supply of a second type of current.

2. The hand-held lamp of claim 1 further comprising:

a ballast housed within the electronics housing in electrical communication with an ignition device housed within the illumination unit;

wherein the first type of electrical current is alternating current and electrical power is provided to the bulb via the ballast and ignition unit.

3. The hand-held lamp of claim 1 wherein the second type of current is direct current and the power converter is an inverter.

4. The hand-held lamp of claim 1 wherein the first type of current is direct current and the power converter is an alternating current to direct current converter.

5. The hand-held lamp of claim 1 further comprising a flexible electrical conduit connecting the illumination unit and electronics housing, wherein all of the electric communication between the illumination unit and electronics housing travel through the conduit.

6. The hand-held lamp of claim 1 wherein the receptacle is a multi-pin receptacle.

7. The hand-held lamp of claim 6 wherein the multi-pin receptacle has 6 pins.

8. The hand-held lamp of claim 1 wherein the lamp is an inspection lamp and further comprises a light filter secured to an end of the illumination unit.

9. The hand-held lamp of claim 8 wherein the lamp is a n ultra-violet inspection lamp.

10. The hand-held lamp of claim 1 further comprising a reflector contoured to focus light from the bulb into a beam having a long focal length, the reflector being secured to the base of bulb to form an assembly adapted to mount within the illumination unit.

11. The hand-held lamp of claim 10 further comprising a cover removeably attached to the reflector such that the cover can be removed from the reflector after the bulb/reflector assembly has been installed in the illumination unit by an installer without the installer touching the reflector, the cover comprising, a base having a periphery corresponding with the shape and size of a periphery of the reflector, and a cover handle.

12. The hand-held lamp of claim 11 wherein the cover is formed from cardboard.

13. The hand-held lamp of claim 11 wherein the cover handle extends perpendicular from the base.

14. The hand-held lamp of claim 11 wherein the cover handle comprises punch-out tabs in the base through which an installer may put fingers.

15. The hand-held lamp of claim 11 wherein the cover is removeably attached to the reflector by two or more tabs extending through two or more apertures in an external collar on the reflector.

16. The hand-held lamp of claim 1 wherein at least one of the connections in electrical communication with the illumination unit independent of the power converter is also in electrical communication with the illumination unit via the power converter.

17. The hand-held lamp of claim 1 wherein the illumination unit and electrical housing are housed within a common shell.

18. The hand-held lamp of claim 17 wherein the carry handle comprises part of the shell.

19. A hand-held inspection lamp comprising:

an illumination unit having a bulb capable of utilizing a first type of electrical current;

means for converting a second type of electrical current to the first type of current;

means for interchangeably electrically connecting the illumination unit to a first power cord such that the first type of current is supplied to the bulb without passing through the converting means and connecting the illumination unit to a second power cord such that the second type of current is supplied to the illumination unit through the converting means.

20. The hand-held inspection lamp of claim 19 further comprising:

means for reflecting light such that the reflected light has a long focal length, the reflecting means adapted to be installed in the illumination unit; and means for installing the reflecting means into the illumination unit such that an installer need not touch the reflecting means.

21. The hand-held inspection lamp of claim 19 wherein the first type of electrical current is alternating current.

22. The hand-held inspection lamp of claim 21 wherein the bulb is a micro-discharge halide light source.

23. The hand-held inspection lamp of claim 21 further comprising ballasting equipment and an ignition device, wherein when the lamp is switched on, the bulb is connected to alternating current via ballasting equipment and an ignition device.

24. The hand-held inspection lamp of claim 23 wherein the converting means is an inverter and power is supplied to the ballasting equipment via the inverter when the lamp is switched on and a cord carrying direct current is connected to the interchangeably connecting means.

25. The hand-held inspection lamp of claim 19 wherein the first type of electrical current is direct current.

26. The hand-held inspection lamp of claim 25 wherein the bulb is a tungsten-halogen bulb.

27. A hand-held inspection lamp comprising:

an illumination unit adapted to receive a bulb for utilizing a first type of electrical current; and an electronics housing having a multi-connection receptacle in electrical communication with the illumination unit and a power converter, the multi-connection receptacle comprising, first and second electrical connections in electrical communication with the illumination unit independent of the power converter, third and fourth electrical connections in electrical communication with the power converter.

28. The hand-held inspection lamp of claim 27 further comprising:

a first power cord having a first termination adapted to connect to an alternating current electrical power source;

a second power cord having a first termination adapted to connect to a direct current electrical power source;

the first and second power cords each having a second termination adapted to connect to the multi-connection receptacle such that either the first or second power cord may be connected to the receptacle at a time;

wherein the second termination of the first power cord communicates with the first and second connections of the receptacle when connected thereto; and wherein the second termination of the second power cord communicates with the third and fourth connections of the receptacle when connected thereto.

29. The hand-held inspection lamp of claim 28 wherein the connections of the receptacle comprise pins and the second terminations of the power cords comprise pin sockets.

30. The hand-held inspection lamp of claim 27 further comprising:

a fifth connection in the receptacle in electrical communication with the fourth connection;

a first power cord having a first termination adapted to connect to an alternating current electrical power source;

a second power cord having a first termination adapted to connect to a direct current electrical power source;

the first and second power cords each having a second termination adapted to connect to the multi-connection receptacle such that either the first or second power cord may be connected to the receptacle at a time;

wherein the second termination of the first power cord comprises connections corresponding with the second and fourth connections of the receptacle and an electrical bridge between the first and third connections of the receptacle when connected thereto; and wherein the second termination of the second power cord communicates with the second and fourth connections of the receptacle and electrically connects the first and fifth connections of the receptacle when connected thereto.

31. The hand-held inspection lamp of claim 30 wherein the fourth connection is electrically connected to both an alternating current to direct current converter and to the fifth connection via a switch.

32. The hand-held inspection lamp of claim 31 wherein the third connection of the receptacle is isolated by the second termination of the second cord when connected thereto.

33. The hand-held inspection lamp of claim 30 wherein the connections of the receptacle comprise pins and the second terminations of the power cords comprise pin sockets.

34. A hand-held inspection lamp comprising:

an illumination unit adapted to receive a bulb that utilizes alternating current;

an electronics housing having an inverter wired to supply power to a ballast, the ballast being in electrical communication with the illumination unit;

a multi-connection receptacle including a set of connections adapted to complete a circuit between the ballast and a first power cord carrying alternating current when connected thereto, and to complete a circuit between the inverter and a second power cord carrying direct current when connected thereto.

35. The hand-held inspection lamp of claim 34 wherein the multi-connection receptacle comprises first, second, third, fourth, fifth and sixth electrical connections.

36. The hand-held inspection lamp of claim 35 wherein the first connection is connected to a positive terminal of the inverter, the second connection is connected to a negative terminal of the inverter, the third and fourth connections are connected to an alternating current output of the inverter, and the fifth and sixth connections are connected to the ballast.

37. The hand-held inspection lamp of claim 36 wherein the first power cord comprises a termination adapted to connect with the receptacle such that alternating current is provided to the fifth and sixth connections.

38. The hand-held inspection lamp of claim 37 wherein the termination of the first power cord comprises a ground terminal which connects with the second connection when connected to the receptacle.

39. The hand-held inspection lamp of claim 36 wherein the second power cord comprises a termination adapted to connect with the receptacle such that direct current is supplied to the receptacle through the first and second connections.

40. The hand-held inspection lamp of claim 39 wherein the termination of the second power cord further comprises an electrical bridge between the third and fifth connections and an electrical bridge between the fourth and sixth connections.

41. A hand-held inspection lamp comprising:

an illumination unit adapted to receive a bulb that utilizes direct current;

an electronics housing having an alternating current to direct current converter in electrical communication with the illumination unit;

a multi-connection receptacle including a set of connections adapted to complete a circuit between the illumination unit and a first power cord carrying direct current when connected thereto, and to complete a circuit between the converter and a second power cord carrying alternating current when connected thereto.

42. The hand-held inspection lamp of claim 41 wherein the multi-connection receptacle comprises first, second, third, fourth, fifth and sixth connections.

43. The hand-held inspection lamp of claim 42 wherein the first connection is electrically connected in parallel to an input of the converter and to the sixth connection, the second and fifth connections are connected to the illumination unit, the third connection is a ground terminal, and the fourth connection is connected to an output of the converter.

44. The hand-held inspection lamp of claim 43 wherein the first power cord comprises a termination adapted to connect with the receptacle such that direct current is provided to the first and fifth connections.

45. The hand-held inspection lamp of claim 44 wherein the termination of the first power cord further comprises an electrical bridge between the second and sixth connections.

46. The hand-held inspection lamp of claim 45 wherein the termination of the first power cord isolates the third and fourth connections.

47. The hand-held inspection lamp of claim 43 wherein the second power cord comprises a termination adapted to connect with the receptacle such that alternating current is supplied to the receptacle through the first and fifth connections.

48. The hand-held inspection lamp of claim 47 wherein the termination of the second power cord further comprises an electrical bridge between the second and fourth connections.

49. The hand-held inspection lamp of claim 48 wherein the termination of the second power cord further comprises a ground terminal adapted to connect with the third connection.

50. The hand-held inspection lamp of claim 49 wherein the termination of the second power cord isolates the sixth connection.

* * * * *